United States Patent [19]

Eustace

[11] Patent Number: 4,660,676

[45] Date of Patent: Apr. 28, 1987

[54] DUCTLESS ACOUSTICAL NOISE ATTENUATOR

[75] Inventor: Robert H. Eustace, Winter Springs, Fla.

[73] Assignee: The United States of America as represented by the Secretary of the Air Force, Washington, D.C.

[21] Appl. No.: 838,850

[22] Filed: Mar. 12, 1986

[51] Int. Cl.[4] ..... E04F 17/04

[52] U.S. Cl. ..... 181/224; 181/284; 98/DIG. 10

[58] Field of Search ..... 181/200, 204, 224, 284, 181/265; 98/DIG. 10

[56] References Cited

U.S. PATENT DOCUMENTS

| | | | |
|---|---|---|---|
| 1,772,589 | 8/1930 | Beamer | 181/265 |
| 1,816,769 | 7/1931 | Fisk | 181/224 |
| 1,938,798 | 12/1933 | Bourne | 181/224 X |
| 2,853,147 | 9/1958 | D'Eustachio | 181/224 |
| 2,973,703 | 3/1961 | Jack | 98/40 |
| 3,085,647 | 4/1963 | Jenn et al. | 181/224 |
| 3,482,504 | 12/1969 | Spradling | 181/224 X |
| 3,507,356 | 4/1970 | Smith | 181/224 |
| 4,068,736 | 1/1978 | Dean et al. | 181/224 |
| 4,164,265 | 8/1979 | Kucharczyk | 181/224 |
| 4,287,962 | 9/1981 | Ingard et al. | 181/224 |
| 4,336,863 | 6/1982 | Satomi | 181/224 |
| 4,362,223 | 12/1982 | Meier | 181/206 |
| 4,432,434 | 2/1984 | Dean, Jr. | 181/224 X |

*Primary Examiner*—Benjamin R. Fuller

*Attorney, Agent, or Firm*—William G. Auton; Donald J. Singer

[57] ABSTRACT

A ductless noise attenuator is disclosed which includes a supply fitting mounted between an air conditioning unit and a recipient. The supply fitting blocks line-of-sight soundwaves using triangular-shaped protrusions on the inlet and outlet edges of a housing, and a diamond-shaped core which fits in the housing and has edges which extend to the space between the triangular-shaped edges of the inlet and outlet of the housing. The diamond-shaped core is composed of: two leading edges, which form a wedge with its point facing the housing inlet; and two trailing edges which is overlapped by the triangular protrusions of the housing. Finally, a return fitting conducts air back to the air conditioning unit while blocking line-of-sight soundwaves with a diagonal divider within a return housing. The design of the attenuator is intended to provide a minimum constriction on the airflow from the air conditioning unit, with a maximum of sound attenuation at audible frequencies by blocking line-of-sight soundwaves.

4 Claims, 3 Drawing Figures

DUCTLESS ACOUSTICAL NOISE ATTENUATOR

STATEMENT OF GOVERNMENT INTEREST

The invention described herein may be manufactured and used by or for the Government for governmental purposes without the payment of any royalty thereon.

BACKGROUND OF THE INVENTION

The present invention relates generally to acoustic filters and sound absorbers for air conditioners, and more specifically to a ductless noise attenuator for reducing noise while minimizing constriction of the air flow Air conditioners are becoming more essential for providing temperature control for equipment and personnel. Unfortunately, air conditioning systems produce noise as well as temperature controlled air, and a variety of noise suppression systems have historically been developed. Exemplary in the art are the noise suppression systems of the following U.S. patents, which are incorporated herein by reference:

U.S. Pat. No. 1,816,769, issued to E. Fisk on July 28, 1931;

U.S. Pat. No. 4,068,736, issued to Dean et al on Jan. 17, 1978;

U.S. Pat. No. 4,164,265, issued to E. Kucharczyk on Aug. 14, 1979;

U.S. Pat. No. 4,362,223, issued to I. Meier on Dec. 7, 1982;

U.S. Pat. No. 2,973,703, issued to W. Jack on Mar. 7, 1961;

U.S. Pat. No. 2,853,147, issued to D. D'Eustachio on Sept. 23, 1958; and

U.S. Pat. No. 4,336,836, issued to S. Satomi on June 29, 1982.

The systems cited above have a common characteristic in that they separate the air conditioner from the recipient by a system of ventilators or ducts. While these ducts transmit sound as well as air, the sound is reduced by baffles, gratings, and sound absorbing materials which line the ducts. For example, U.S. Pat. No. 1,816,769 (Fisk) discloses a sound suppressing ventilator which includes a plurality of angulated louvres for effecting sound attenuation. U.S. Pat No. 4,165,265 (Kucharczyk) discloses a sound attenuating baffle, which is positionable within a sound-absorbing ventilator, and wherein the baffle includes a plurality of angulated members for directing sound in various desired directions. U.S. Pat. No. 4,362,223 (Meier) discloses a sound absorbing device positionable within a fluid flow channel, the device including a plurality of angulated members for reflecting and absorbing sound.

While the ventilator constrictions described in the cited references are certainly effective, they are both expensive and tend to constrict the air flow from the air conditioner. In view of the foregoing discussion, it is apparent that there currently exists the need to reduce the noise from air conditioning units while minimizing the restriction of the air flow from these units. The present invention is intended to satisfy that need.

SUMMARY OF THE INVENTION

The present invention is a ductless noise attenuator which contains a supply fitting which is mounted between the air conditioning unit and the room or shelter being cooled by the air conditioner. This ductless noise attenuator is designed to provide sound attenuation based on the following design principle: "sound attenuation is maximized at audible frequencies when line-of-sight soundwaves are blocked".

The supply fitting of the present invention is designed to minimize constriction of the air flow of an air conditioner by blocking line-of-sight sound waves using: a housing, and a central diamond-shaped core fixed within the housing. The housing has side walls which have triangular-shaped protrusions on the inlet and outlet ends of the supply fitting. The diamond-shaped core sits within the housing so that its edges extend into the space between the triangular-shaped protrusions of the side walls and thereby block line-of-sight soundwaves. In the preferred embodiment, the air is allowed to flow through openings in the core, which contains interior reflecting surfaces which serve to block line-of-sight soundwaves.

In central air conditioning systems which provide a return passage for air to flow back to the air conditioning unit, the invention also provides a return fitting for conducting air from the recipient to the air conditioner. Both the return fitting and supply fitting are composed of a plurality of angulated, acoustically-treated sound reflecting surfaces which block line-of-sight soundwaves. In one embodiment, an electromagnetic interference (EMI) screen is fitted on both the supply and return fittings to protect equipment from interference by the air conditioning unit, but such a screen is not essential to the invention.

It is a principal object of the present invention to reduce sound from air conditioning systems while minimizing constriction of the air flow.

It is another object of the present invention to provide a ductless noise attenuation system between the supply of air from the air conditioning unit and the recipient of cooling air.

It is another object of the present invention to attenuate noise by blocking line-of-sight soundwaves between an air conditioning unit and the recipient.

These objects together with other objects, features and advantages of the invention will become more readily apparent from the following detailed description when taken in conjunction with the accompanying drawings wherein like elements are given like reference numerals throughout.

DETAILED DESCRIPTION OF THE PREFERRED EMBODIMENT

The present invention is a ductless acoustical noise attenuator for reducing the noise from an air conditioning unit with minimal constriction of the air flow.

Most prior art systems entail a use of baffles, gratings, and sound absorbing materials to line the ducts of a ventilator system which conducts air from the air conditioning unit to the recipient. These ducts are effective, but are also expensive and tend to constrict the air flow. In the present invention, ductless noise attenuation is provided using a supply fitting which is mounted between the air conditioning unit and the room or shelter being cooled.

Figure 1:
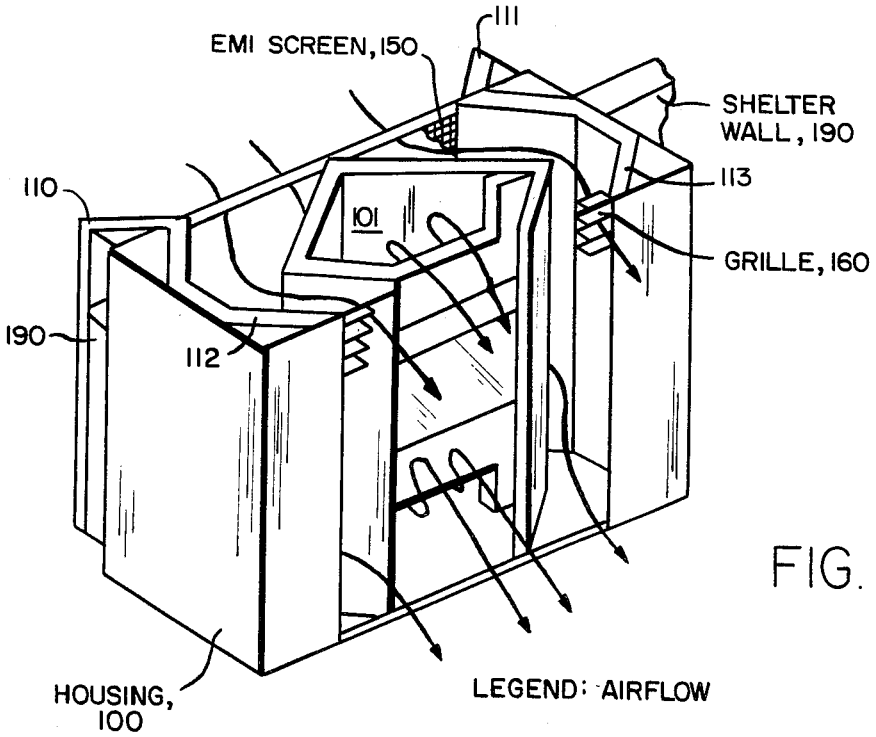
FIG. 1 is a view of the supply fitting of the attenuator from the recipient side.

The reader's attention is now directed towards FIG. 1, which is a view of the supply fitting of the attenuator from the recipient side. This ductless noise attenuator is based upon the following design principle: "sound attenuation is maximized at audible frequencies when line-of-sight soundwaves are blocked".

Line-of-sight soundwaves are blocked by the supply fitting of FIG. 1 which is comprised of: a housing 100 which has protruding side walls, and a central diamond-shaped core 101 fixed in the housing. The housing 100 has triangular shaped protrusions 110–113 on the inlet and outlet ends of its side walls which extend into the interior of the housing. The diamond-shaped core 101 in the housing 100 has edges that extend into space between the inlet and outlet triangular shaped protrusions to block line-of-sight soundwaves while minimizing constriction of the airflow from the air conditioning unit. The airflow is further enhanced by the fact that the central core is hollow with one or more vertically stacked apertures on its inlet side. These apertures are level with a plurality of vertically stacked deflectors which block line-of-sight soundwaves while allowing air to flow through the central core. These apertures are more clearly seen in FIG. 2.

Figure 2:
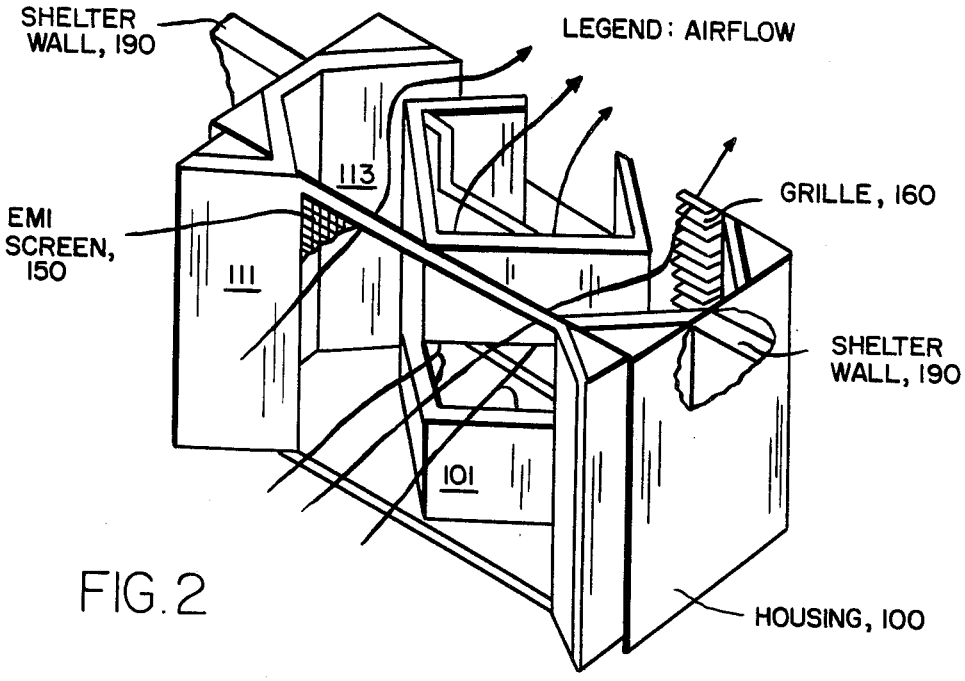
FIG. 2 is a view of the supply fitting of FIG. 1 from the air conditioning unit side.

The supply fitting of both FIG. 1 and FIG. 2 has an electromagnetic interference (EMI) screen 150 on its inlet side. Such screens are known in the art and tend to shield equipment from any electromagnetic interference which may arise from the air conditioning unit. While this EMI screen is not essential to the noise-attenuating properties of the invention, it is essential to computers and similar equipment because the invention is a ductless noise attenuator. In other words, the air conditioning unit is more likely to be in the immediate proximity of the recipient with the present invention than with prior art systems which use ventilators.

FIG. 2 is a view of the supply fitting of FIG. 1 showing the inlet side which faces the air conditioning unit. The diamond-shaped core 101 is depicted as having a wedge-shaped front facing the inlet of the supply fitting. Also, the core 101 has an aperture in its inlet side which conducts air into its hollow interior and to the recipient. As mentioned above, a plurality of vertically stacked apertures can be in this core, but for each aperture, a deflector is positioned within the core behind it to block line-of-sight soundwaves.

A final element of the supply fitting is a grill 160 which is placed on the outlet side of the supply fitting. This grill consists of two vertical stacks of horizontal plates which stretch between the triangular-shaped protrusions in the outlet side of the housing and the diamond-shaped core. This grill 160 serves as a baffle to further attenuate the noise from the air conditioning unit.

Figure 3:
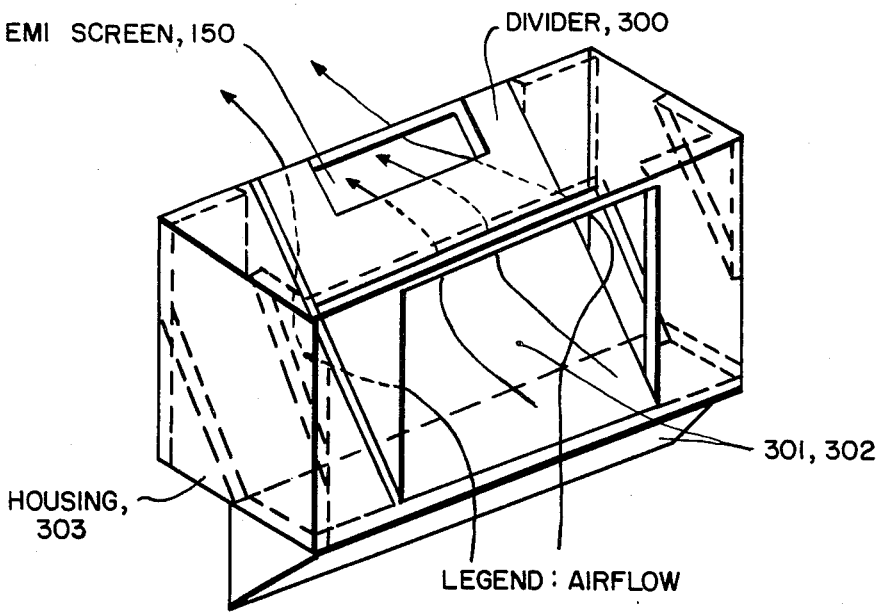
FIG. 3 is a view of the return portion of the attenuator.

FIG. 3 is a view of the return fitting of the attenuator. This return fitting is used when a return passage is needed for air to flow back to the air conditioning unit. Like the supply fitting, the return fitting is designed to block line-of-sight soundwaves. In the return fitting soundwaves are blocked by a diagonal divider 300 which extends from the lower back of the fitting towards the top front on outlet side. The air enters the return fitting from the bottom, flows around the diagonal divider and out the front to return to the air conditioning unit. Additionally, a central aperture allows air to enter the back of the return fitting. Both this side inlet aperture in the back and the lower inlet aperture in the bottom are covered by conventional air filters. The outlet aperture in the front of the return fitting is covered by an EMI screen similar to the screen used in the supply fitting.

To further attenuate noise from the air conditioning unit, an acoustical lining coats all surfaces facing the air conditioning unit in the supply and return fittings. A variety of acoustical linings are known in the art and may be used. In this invention TUFCOTE Noise Barrier #104 and a coating of TUFCOTE Acoustical Foam was used. Please note that "TUFCOTE" refers to a registered trademark of the Specialty Composites Corporation, but other linings known in the art may also be used. The surfaces which were coated with this acoustical lining include: the triangular-shaped protrusions in the housing, the outside surfaces of the diamond-shaped core, and the diagonal divider in the return fitting. Also the deflectors within the diamond-shaped core are coated with this acoustical lining include: the triangular-shaped protrusions in the housing, the outside surfaces of the diamond-shaped core, and the diagonal divider in the return fitting. Also the deflectors within the diamond-shaped core are coated with the lining.

While the invention has been described in its presently preferred embodiment it is understood that the words which have been used are words of description rather than words of limitation and that changes within the purview of the appended claims may be made without departing from the scope and spirit of the invention in its broader aspects.

What is claimed is:

1. A ductless noise attenuator comprising:

a housing which is mounted between an air conditioning unit and a recipient, said housing conducting an air flow from said air conditioning unit to said recipient and having an inlet with inlet edges which protrude into the housing's interior, said housing also having an outlet with outlet edges which protrude into the housing's interior; and a diamond-shaped core mounted in said housing which blocks line-of-sight soundwaves from the air conditioning unit while allowing the air flow to pass to the recipient, said diamond-shaped core including first and second leading edge sides, first and second trailing edges, and a deflector, said first and second leading edge sides fitting together to form a point which faces the inlet of the housing, said first and second leading edges having an aperture in the point to allow the airflow to enter the diamond-shaped core; said first and second trailing edges being respectively connected to the first and second leading edges at positions between the inlet and outlet edges on the sides of the housing, said first and second leading and trailing edges thereby blocking line-of-sight soundwaves from the air conditioning unit; and said deflector being fixed between said first and second leading and trailing edges at a position aligned with the aperture in the point to block line-of-sight soundwaves from the air conditioning unit.

2. A ductless noise attenuator, as defined in claim 1, wherein said inlet and outlet edges in the housing each comprise a triangular-shaped protrusion which extends into the interior of the housing so that it overlaps the leading and trailing edges of the diamond-shaped core.

3. A ductless noise attenuator, as defined in claim 2, including a return fitting which conducts air from the recipient back into the air conditioning unit, said return fitting comprising:

a return housing which receives air from an inlet end and exhausts air to the air conditioning unit out an outlet end; and a diagonal divider fixed diagonally within said return housing to block line-of-sight soundwaves from the air conditioning unit while allowing air to flow around it through the return housing.

4. A ductless attenuator, as defined in claim 3, wherein an acoustical lining coats all surfaces which face the air conditioning unit, said surfaces including: the first and second leading edges and deflector of the diamond-shaped core, the triangular-shaped protrusions of the housing, and diagonal divider of the return fitting.

* * * * *